US007658385B2

(12) United States Patent
Drouhard

(10) Patent No.: US 7,658,385 B2
(45) Date of Patent: Feb. 9, 2010

(54) METHOD OF PLAYING A PURSUIT BOARD GAME

(76) Inventor: Timothy W. Drouhard, P.O. Box 20666, Canton, OH (US) 44701

( * ) Notice: Subject to any disclaimer, the term of this patent is extended or adjusted under 35 U.S.C. 154(b) by 18 days.

(21) Appl. No.: 11/799,922

(22) Filed: May 3, 2007

(65) Prior Publication Data

US 2007/0284816 A1 Dec. 13, 2007

Related U.S. Application Data

(60) Provisional application No. 60/813,136, filed on Jun. 13, 2006.

(51) Int. Cl.
*A63F 3/00* (2006.01)

(52) U.S. Cl. ..... 273/249; 273/243

(58) Field of Classification Search ..... 273/249, 273/243

See application file for complete search history.

(56) References Cited

U.S. PATENT DOCUMENTS 4,003,577 A * 1/1977 Bolach ..... 273/243
4,128,246 A * 12/1978 Hicks et al. ..... 273/243
5,037,111 A * 8/1991 Hofmann ..... 273/248
5,941,525 A * 8/1999 Gallub ..... 273/248

* cited by examiner

*Primary Examiner*—Vishu K. Mendiratta
(74) *Attorney, Agent, or Firm*—Sand & Sebolt

(57) ABSTRACT

A method of playing a board game of pursuit for at least one of a first and a second player; where the board includes a pathway made up from a number of discrete squares and includes at least a starting position. The method of play includes the steps of the first and second players taking alternating turns to determine the number of squares to move along the pathway; deciding whether to move in one of a first and a second direction along the pathway; and positioning a marker at the square so determined. The game ends when the second player is able to position their marker on the same square as the first player. The board may also be provided with a finishing position remote from the starting position. In this instance, the game ends when the first player reaches the finishing position prior to the second player being able to position their marker on the same square as the first player. The game may include hazards along the pathway that require the players to pay a penalty before resuming play. The game may further include objects positioned on squares along the pathway that need to be collected by one or both of the players during play.

16 Claims, 6 Drawing Sheets

METHOD OF PLAYING A PURSUIT BOARD GAME

BACKGROUND OF THE INVENTION

1. Technical Field

This invention generally relates to games. More particularly, the invention relates to a board game and to a method of playing the board game. Specifically, the invention relates to method of playing a pursuit-type board game where a second player pursues a first player along a pathway on the game board by attempting to position a marker in the same place as the first player.

2. Background Information

There are a wide variety of board games that are played by two or more players. Typically, these games have a start and a finish which are linked together by a pathway. The players take turns rolling dice, spinning wheels or selecting cards to determine how many squares to move along the board. The object of the game is to race your opponent to see who reaches the finish line first.

While these games are competitive in nature, there is little skill or decision making involved in the game playing process as moving along the board is determined by the roll of the dice. The winner is therefore lucky and not skillful.

There is room in the art for a board game that is not only competitive in nature, but which also involves skill and decision making on the part of the players.

SUMMARY OF THE INVENTION

A method of playing a board game of pursuit for at least a first and a second player. The game board includes a pathway made up from a number of discrete squares and has at least a starting position. The method of play comprises the steps of the first and second players taking alternating turns determine the number of squares to move along the pathway; deciding whether to move in one of a first and a second direction along the pathway; and positioning a marker at the square so determined. The game ends in a number of ways including when the second player is able to position their marker on the same square as the first player. The game board may also be provided with a finishing position and in this instance the game ends when the first player reaches the finish prior to the second player being able to position their marker on the same square as the first player.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
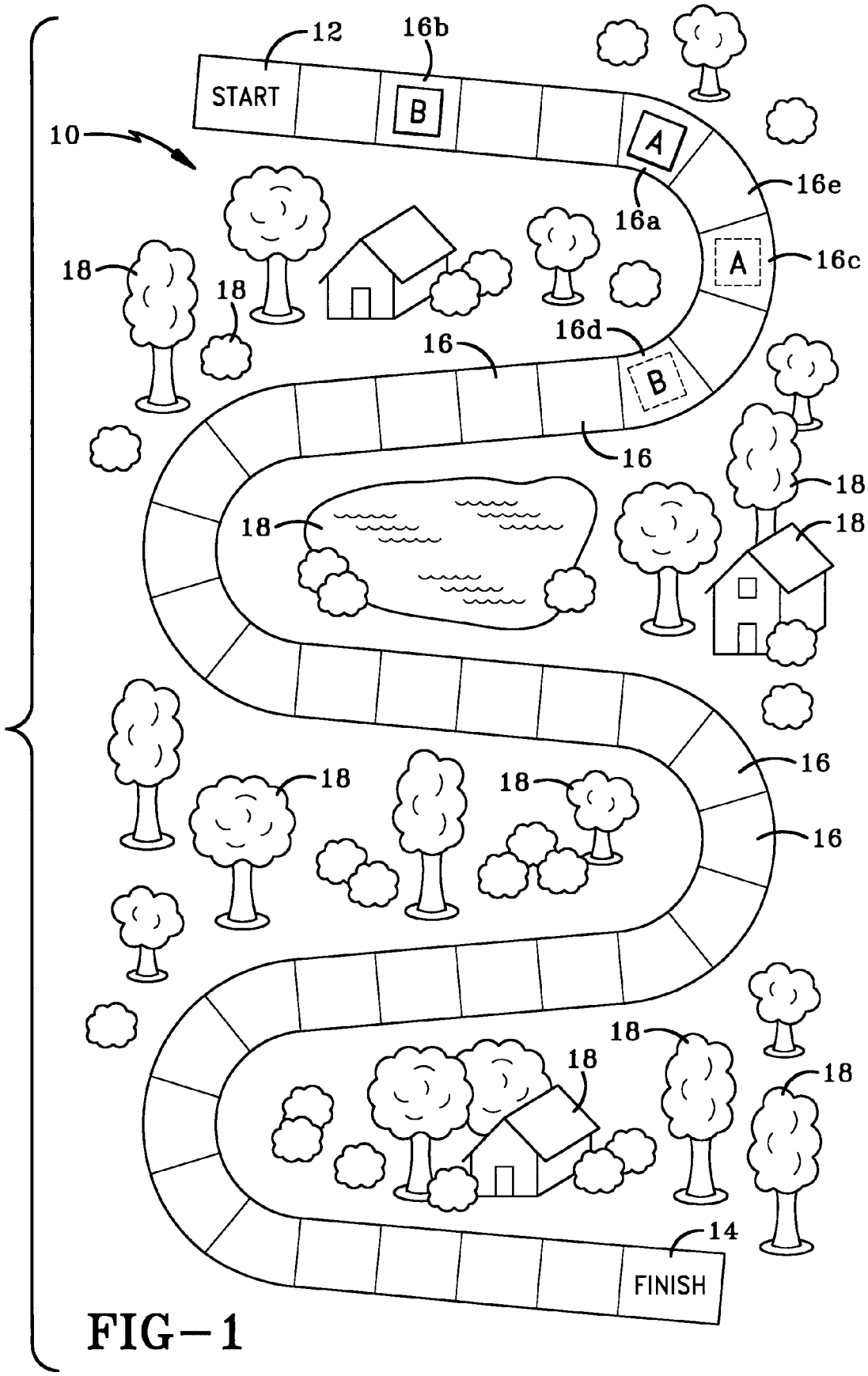
FIG. 1 is a game board pathway that illustrates a first method of playing the game of the present invention.

Referring to FIG. 1, there is illustrated a game board pathway 10 that may be used to describe a first method of playing a game in accordance the present invention. It should be understood that pathway 10 is merely illustrative. The exact design and layout of the game board used in playing the game may be varied without departing from the spirit of the present invention.

Pathway 10 includes a starting position 12 and a home or finishing position 14 which are linked together by a plurality of discrete playing positions 16. The playing positions will be referred to by the term "square" throughout this specification. It will be understood that the term "square" is not necessarily used to designate the specific shape of the playing positions formed on pathway 10, as any suitable shape may be used on the game board to represent the player's position.

Various elements of scenery 18 are positioned around or along pathway 10. The types of scenery 18 selected for the board depend on the setting for the game. So, for example, the game board can be designed as an Easter related game, in which case the scenery 18 could include rabbits, Easter eggs and other Easter-related symbols. Alternatively, the game board may be designed as a Halloween related game with the scenery 18 including illustrations of Jack-O-Lanterns, black cats and the like. Furthermore, the peripheral shape of the board may also be designed to align with the theme of the scenery 18 used thereon. So, for example, in a Halloween-related game the board could be shaped like a pumpkin and for a Christmas-related game the board could be shaped like a Christmas tree.

The games to be played utilizing the game board and the following methods of play are designed for play by at least a first player and a second player. The games may, however, be played by more than two players and in these instances the multiple players may play as individuals, in pairs of players that play together or against each other, or in teams of several players which play against each other. The players use any suitable device for determining how many squares 16 to move along pathway 10. A first such suitable device could be one or more dice, graduated spinning wheels, playing cards etc. When a player lands on a particular square 16, they place a marker on that square to indicate their position on the pathway 10 as will be described hereinafter.

In a first method of play of the board game, the game is a game of pursuit in which one of the players is chasing another of the players along pathway 10. The first player tries to evade capture and reach finish 14 before the second player captures them. If the second player manages to land on a square 16 occupied by the first player before the first player reaches finish 14, then the first player is captured and that round of the game is over.

In a second method of play of the board game, the game is a pursuit type game that includes obstacles or hazards. The obstacles or hazards are provided on the game board in preset positions and require that the player landing on the associated square pay some sort of penalty in order to advance. In an alternative version of this game, one or both players may be provided with obstacles or hazards which they may selectively place on pathway 10 to interfere with the opposing player. The game ends if the pursued player is captured by the pursuer landing on the same square or by the pursued player reaching finish 14.

In a third method of play of the board game, the game is a game of tag. The first player is pursued by the second player and, if caught or overtaken, the first player becomes the pursuer and the second player becomes the pursued. Whichever of the first and second players reach finish 14 first, that player is the declared the winner of the game.

In a fourth method of play of the board game, the players are required to collect a certain number of objects as they move along pathway 10. The first player to reach finish 14 with the required objects is declared the winner of the game. Alternatively, the first player to collect a specified number of objects may be declared the winner of the game.

In a variation of any of the above methods of play, the first and second players may select to move in either direction along pathway 10 provided a sufficient number of squares 16 are available for movement in the selected direction. This means that the players can move their marker the rolled number of squares 16 toward the finish 14 or toward the start 12 in order to evade capture or attempt capture, to avoid obstacles or to capture objects that are required as part of the method of play.

Referring to FIG. 1, the first method of playing a pursuit game is described. By way of illustration, the method of play will be described for two players, namely Player 1 and Player 2, whose positions on pathway 10 are shown by the markers "A" and "B". Players 1 and 2 roll a single die to determine how many squares 16 to advance along pathway 10. Both Players 1 and 2, begin at the start 12 and take turns rolling the die. Player 1 is the "pursued" player and Player 2 is the "pursuer". The objective of the game is for Player 1 to reach the finish or home 14 before being captured by Player 2 by landing on the same square.

To start the game, Player 1, rolls the die. In the game illustrated in FIG. 1, Player 1 has rolled a five and has advanced from start 12 to square 16*a* and has placed his marker "A" on square 16*a*. Player 2, then rolls the die. Player 2 has rolled a three and has advanced from start 12 to square 16*b* and has placed his marker "B" thereon.

In the second round of the game, Player 1 rolls a two and advances to square 16*c*. If Player 2 now rolls a four, that player will also land up on square 16*b* and will capture player 1, leading to the end of the game. On the other hand, if Player 2 rolls another number, such as a one or a two, he can move either forwardly toward the finish 14 or rearwardly toward the start 12. If Player 2 rolls a three or more, he has to move toward the finish 14 as he cannot return to start 12. In the illustration, Player 2 has rolled a six, and has had to move his marker to square 16*d*.

If in round three, Player 1 rolls a one then he may move one square rearwardly toward the start 12 or one square forwardly toward the finish 14. Player 1 cannot, however, land on a square which is occupied by Player 2, otherwise Player 1 is considered captured. If Player 1 decides to move one square rearwardly to square 16*e* and in the next round Player 2 rolls a two, then Player 2 can move two squares rearwardly and capture Player 1. In this instance, Player 2 would be declared the winner of the game. If, on the other hand, Player 1 manages to reach finish 14 without being captured, then Player 1 would be declared the winner of the game. Furthermore, if Player 2 reaches the finish 14 before Player 1, then Player 1 is considered the winner of the game. Player 1 and Player 2 must have an exact number roll on the die in order for them to land on the square designating the finish 14.

In a variation of the game there may be more than just two players. In this instance, Player 1 is still the pursued player and the remaining multiple players all pursue Player 1. The first of the pursuing players to capture Player 1 is determined as the winner of the game.

In a second variation of the game, prior to the start of the game a first number of the multiple players are designated as "pursued" players and a second number of the multiple players are designated as the "pursuing" players. The pursued and the pursuers are then put into pairs of players that play against each. Each pair of players will then land up having one winner in the pair.

A third variation of the game may include the formation of a team of pursuers that play against a team of the pursued. The first member of either team to win the game, wins for the entire team.

Figure 2:
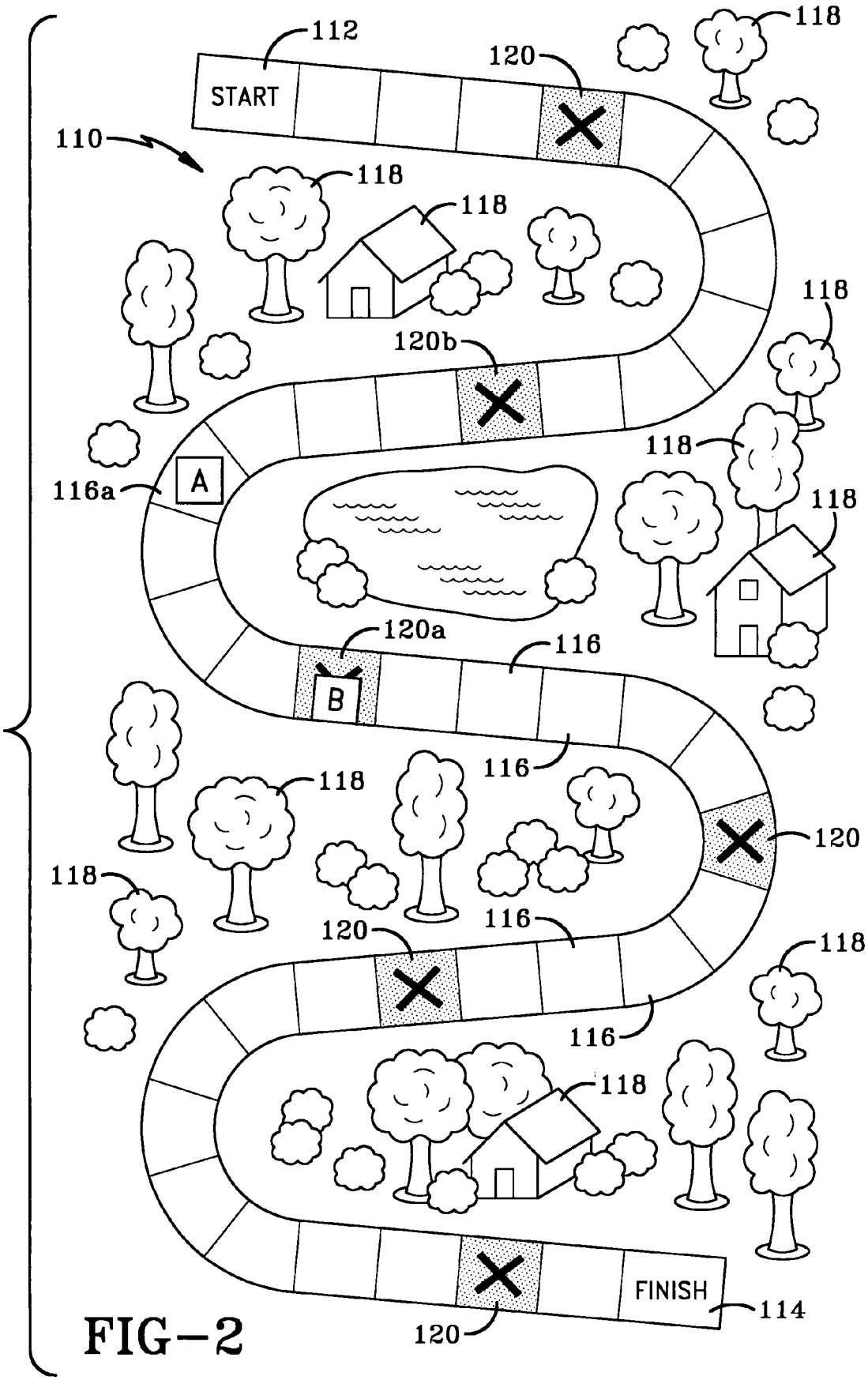
FIG. 2 is a game board pathway that illustrates a second method of playing the game of the present invention.

FIG. 2 shows a second embodiment of the board game that is used with the second method of play, i.e., with a pursuit game that includes hazards. In this second version of the board game, the pathway 110 has a start 112, a finish 114 and a plurality of discrete squares 116 marked thereon. Scenery 118 is disposed at various locations around pathway 110. In accordance with a specific feature of the game, pathway 110 also includes a plurality of hazard squares 120. Hazard squares 120 constitute hazards for one or both players. These hazard squares 120 instruct the player to pay a penalty such as missing one or more turns, rolling a particular predefined number (such as a six or doubles), moving a particular predefined number of squares 116 in either the first or second direction along pathway 110 before they can resume playing the game. The method of playing the game is substantially the same as described in relation to FIG. 1, with the exception of the players having to follow the instructions and pay the required penalty if they land on a hazard square 120. A player, whose roll of the die would position their marker on a hazard square 120 can instead move in the opposite direction to evade that hazard square 120. So, for instance, if Player 1 has a marker "A" on square 116*a* and rolls a four in their next move, then moving in either direction will land them on a hazard square, namely 120*a* or 120*b*. They can therefore select moving in either direction. If, however, Player 2 was positioned on hazard square 120*a*, then Player 2 would move to hazard square 120*b* in order to evade being captured.

In an alternative version of the game, one or both of Players 1 or 2 may be provided with a means for designating squares of their choice as hazard squares 120. So, for example, the players may place small cards (not shown) on squares 116 of their choice to turn those selected squares into hazard squares 120. The cards could indicate what penalty has to be paid by the opposing player before they may continue moving along pathway 110.

In a variation of the above method of play, Player 1 rolls the die first and is the pursued player and Player 2 rolls the dice second and is the pursuer. Both Player 1 and Player 2 can move backwards or forwards along pathway 110. If during the game, Player 2 rolls a number that causes him to pass Player 1, then Player 2 become the pursued and Player 1 becomes the pursuer. The pathway 110 includes a variety of different hazard squares 120, some of which advise the pursued player that an enemy is hiding behind a piece of the scenery 118 on the board and they must roll a specific number and move that number of squares or be automatically deemed caught. The method of play may also include a variation in that when the players are nearing finish 114, they must roll the exact number of squares 116 land on finish 114 and thereby end the game. The players can, again, move either forward toward the finish 114 or back toward the start 112, but if they select to move forward, then any excess in the amount of their roll requires them to move the excess number of squares back toward the start 112.

Figure 3:
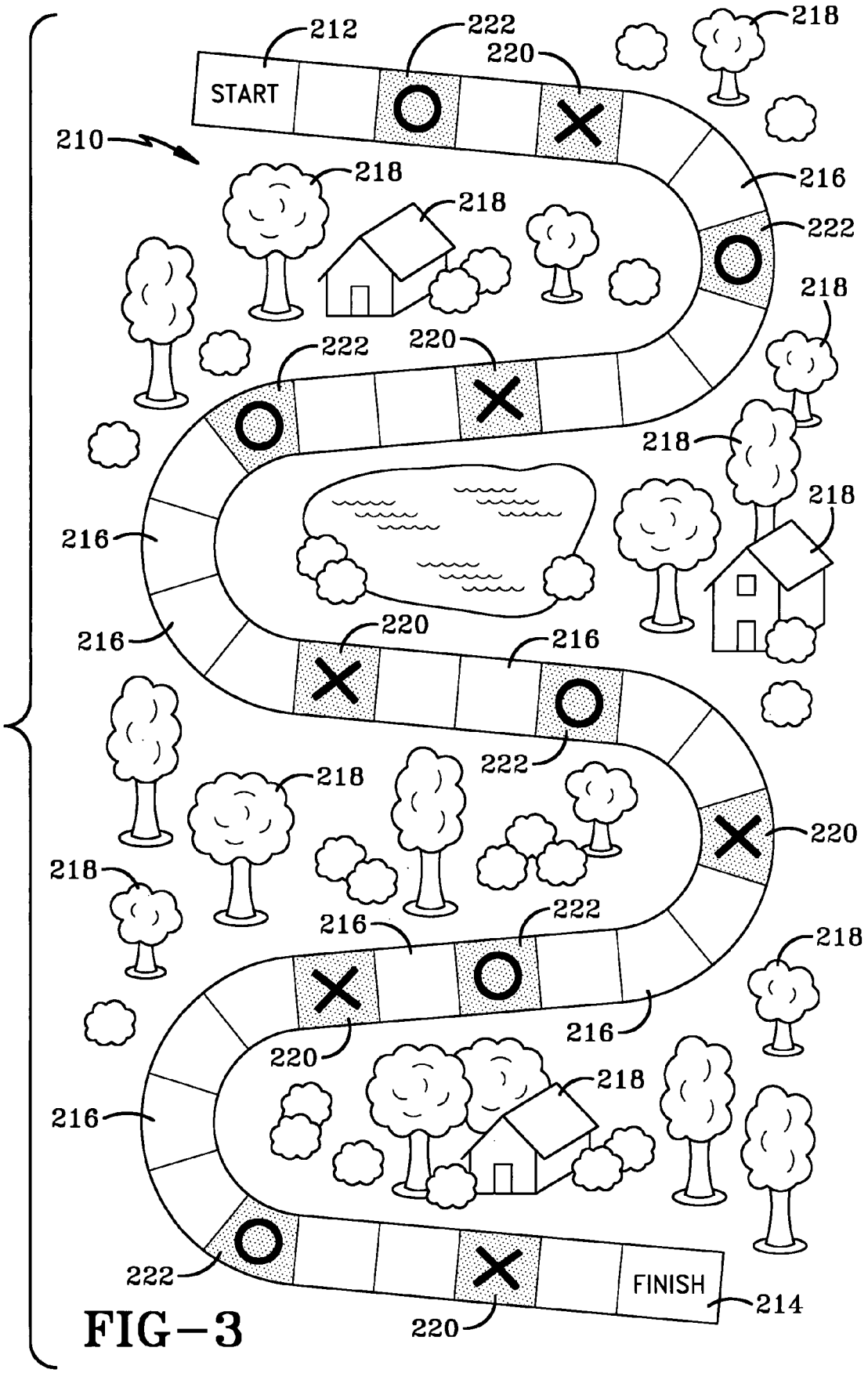
FIG. 3 is a game board pathway that illustrates a third method of playing the game of the present invention.

FIG. 3 shows a third embodiment of the game board that may be used in conjunction with the second method of play of the game. In this version, the pathway 210 has a start 212, a finish 214, a plurality of discrete squares 216 and scenery 218. In accordance with a specific feature of the game, pathway 210 includes a plurality of first hazard squares 220 and second hazard squares 222. Second hazard squares 222 require that the particular player that lands on one of squares 222 to miss one or more turns, roll a particular predefined number or combination of numbers, return to the start or move a predefined number of squares in either the first or second direction along pathway 210. The game is preferably played so that the first hazard squares 220 apply to only the Player 1 and the second hazard squares 222 apply only to the Player 2. The type of penalty that has to be payed by the players can differ from one hazard square to the next, so that the player may have to pay a variety of penalties as they move along the pathway. The method of playing the game is substantially the same as with either of the first and second embodiments of the method of play, except for the addition of the steps that when the Player 1 lands on one of the first hazard squares 220 they have to pay the appropriate penalty for that square, and if the second player lands on one of the second hazard squares 222 they have to pay the appropriate penalty for that square.

Figure 4:
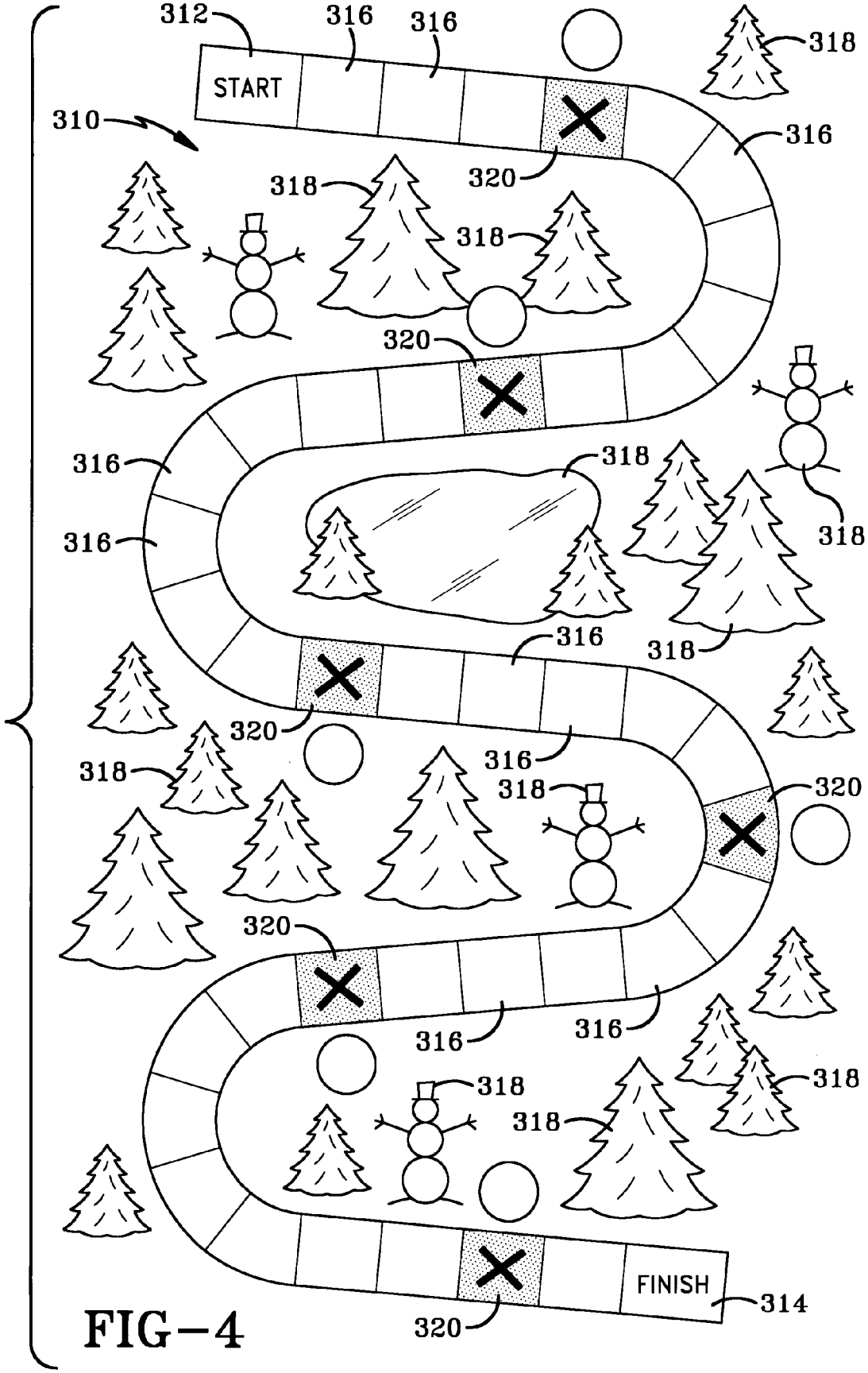
FIG. 4 is a game board pathway that illustrates a fourth method of playing the game of the present invention.

FIG. 4 shows a fourth embodiment of the game. In this version of the game, the pathway 310 again includes a start 312, a finish 314, discrete squares 316 and scenery 318. The pathway 310 further includes hazard squares 320. If a player lands on a hazard square 320, they are automatically deemed caught unless they can roll a six, a pair of doubles or pay some other specified penalty on their next roll. If they do manage to make the specified roll, such as a six, they then move their marker six squares and the game continues.

Figure 5:
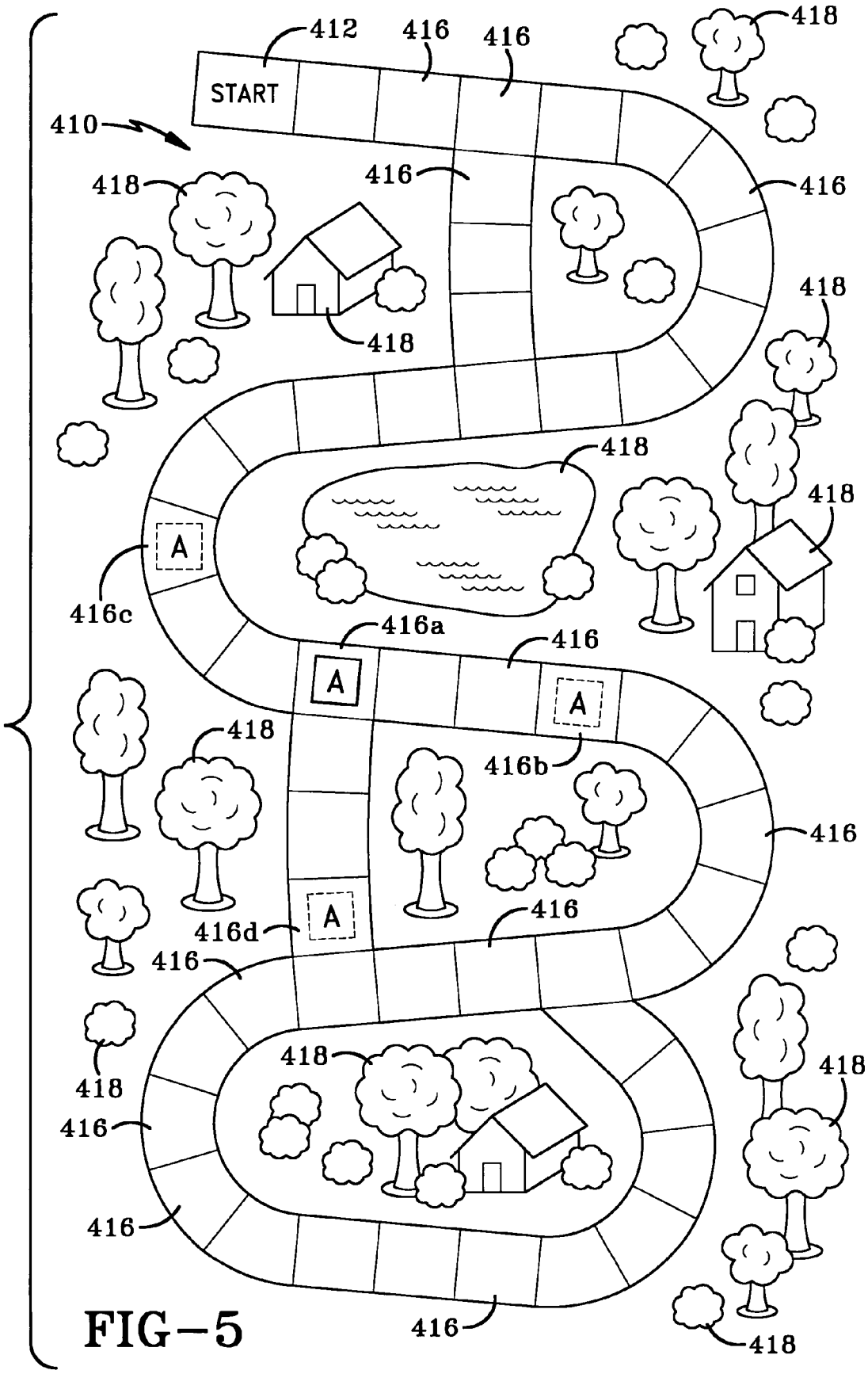
FIG. 5 is a game board pathway that illustrates a fifth method of playing the game of the present invention.

FIG. 5 illustrates a fifth embodiment of the game which may be used with the third method of play, i.e., a game of tag. In this version, the pathway 410 has a start 412, a plurality of discrete squares 416 and scenery 418. There is, however, no finish and the pathway 410 essentially is a closed loop where both of the players can move their markers in any direction along the pathway 410. So, for example, if Player 1 lands on the square 416*a*, and in their next turn they roll a three, they may move to square 416*b*, 416*c* or 416*d*. The game continues until Player 2, the pursuer, captures Player 1, the pursued, by landing on the same square in the pathway 410. At this point, Players 1 and 2 can swap rolls and Player 1 becomes the pursuer while Player 2 becomes the pursued.

Figure 6:
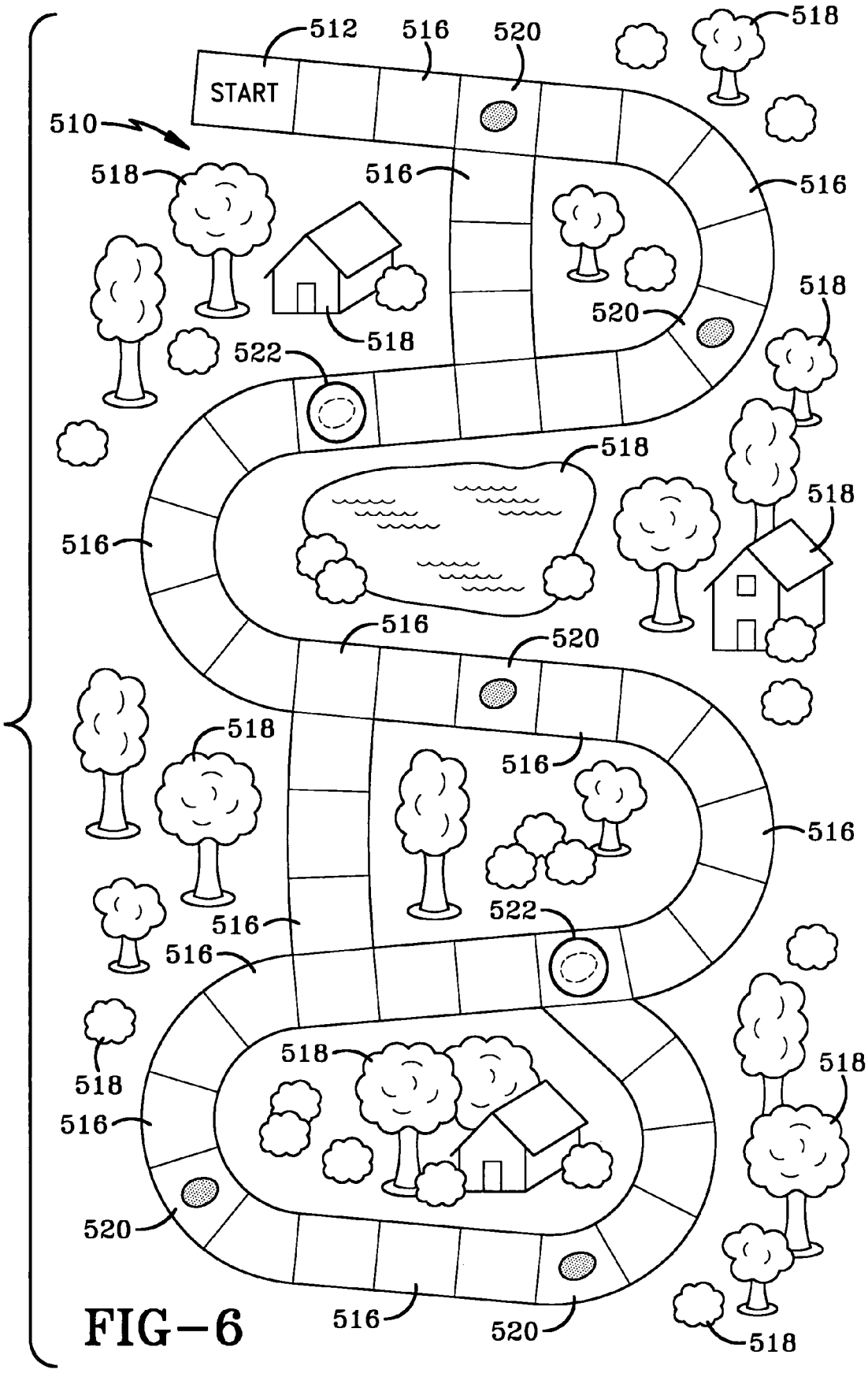
FIG. 6 is a game board pathway that illustrates a sixth method of playing the game of the present invention.

FIG. 6 illustrates a sixth embodiment of the game that may be used. In this version, the pathway 510 has a start 512, a plurality of discrete squares 516, scenery 518, first hazard squares 520 and second hazard squares 522. Again, as with the previous embodiment, there is no finish and the pathway 510 is endless. The first hazard squares 520 may apply only to the Player 1 and the second hazard squares 522 may apply only to the second player. The respective first and second players have to pay the specified penalty if they land on the first and second hazard squares 520, 522. The players can move their markers in any direction in order to evade a relevant hazard square 520, 552 or to evade or capture their opponent. Alternatively, both hazard squares 520 and 522 may apply equally to both players. This embodiment of the board game may also be used to play the fourth method of play of a game. In this instance, instead of hazard squares 522 being a penalty of some type, those squares may instead represent articles or objects that the player is to collect by covering them with indicators of some type (not shown) such as cards that represent that player. When one of the players lands on an appropriate square 522, they place one of their indicators over the square to "capture" or "collect" the article. So, for example, if the game is an Easter-related game, the squares 522 may be a representation of an Easter egg for the player to collect. As the players advance along the pathway 510, if they land on square 522, they place their relevant indicator over square 522 to thereby indicate that they have collected or captured the same. The game may be played so that the players need to capture a specified number of articles in order to win. Alternatively, one of the players attempts to capture the other of the players before they collect a specified number of articles.

In an alternative version of the game (not shown), the pathway may include a finish and the players have to collect a specified number of articles before they reach the finish in order to be declared the winner.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A method of playing a board game of pursuit for a first player and a second player; the method comprising the steps of:

a) providing a game board that includes a start and a plurality of discrete spaces that form a pathway;

b) providing a device for determining the number of spaces to be moved along the pathway;

c) determining an order of play such that the first player plays first and the second player plays second;

d) activating the device to determine a first number of spaces the first player is to move along the pathway;

e) moving a first marker from the start in a first direction along the pathway;

f) positioning the first marker at a first space correlating to the first number;

g) activating the device to determine a second number of spaces the second player is to move along the pathway;

h) moving a second marker from the start in the first direction along the pathway;

I) positioning the second marker at a second space that correlates to the second number;

j) activating the device to determine a third number of spaces the first player is to move along the pathway;

k) determining whether to move the first marker in one of the first direction and an opposing second direction along the pathway in order to avoid positioning the first marker on the second space with the second marker;

l) moving the first marker in the selected one of the first and second directions along the pathway;

m) positioning the first marker at a third space that correlates to the third number;

n) activating the device to determine a fourth number of spaces the second player is to move along the pathway;

o) determining whether to move the second marker in one of the first and second directions along the pathway so as to try and position the second marker on the third space with the first marker;

p) moving the second marker in one of the first and the second directions along the pathway;

q) positioning the second marker at a fourth space that correlates to the fourth number; and r) repeating steps n) through q) until the second marker is positionable on a same space as the first marker; wherein the first player is considered to be captured; and s) reversing the order of play when the first player is one of overtaken and captured such that the second player plays before the first player.

2. The method of playing a board game as defined in claim 1, wherein the step of providing a board includes providing a board where the pathway includes a finish that is remote from the start; and wherein the game is concluded when the first player is one of captured or the first marker is placeable upon the finish.

3. The method of playing a board game as defined in claim 1, wherein the step of providing a board includes providing a board where the pathway further includes a plurality of hazard spaces that are positioned at intervals along the pathway; and the method of play further includes the step of one of the first and second players having to pay a penalty when their one of the first and second markers is placeable upon one of the hazard spaces.

4. The method of playing a board game as defined in claim 3, wherein the step of paying the penalty comprises one of missing one or more turns, moving a predefined number of spaces in one of the first and second directions along the pathway, and determining a predefined number of spaces to be moved before play is resumed.

5. The method of playing a board game as defined in claim 4, wherein the hazard spaces apply to only one of the first and second players and wherein the method of play further includes the step of that one of the first and second players having to pay the penalty when their one of the first and second markers is placeable on one of the plurality of hazard spaces.

6. The method of playing a board game as defined in claim 4, wherein both of the first and second players are provided with a plurality of hazard indicators, each hazard indicator requiring that a penalty be paid before play is resumed; and wherein the method of play further includes the step of placing at least one or more of the hazard indicators along the pathway.

7. The method of playing a board game as defined in claim 1, wherein the board further includes a plurality of collectable objects each positioned in one of a plurality of object spaces disposed at intervals along the pathway; and wherein the method of play further includes placing a player identifier over one of the object spaces when one of the first and second markers is positionable thereon.

8. The method of playing a board game as defined in claim 7, wherein the method of play further includes the step of gathering all of the collectable objects within the object spaces; whereby the first of the first and second players to collect all of said objects is declared the winner of the game.

9. The method of playing a board game as defined in claim 7, wherein the board game pathway includes a finish remote from the start; and wherein the method of play further includes the step of gathering all of the collectable objects within the object spaces must be achieved prior to a step of the first player positioning the first marker on the finish.

10. The method of playing a board game as defined in claim 1, wherein the step of providing a game board includes providing a game board with a finish; and the game further includes the step of ending the game when one of the first and second markers is positionable on the finish.

11. The method of playing a board game as defined in claim 1, further comprising the step of ending the game when the first marker lands upon the same space as the second marker after the step of reversing the order of play.

12. The method of playing a board game as defined in claim 1, wherein the step of reversing the order of play further includes the step of selecting to reverse the order of play instead of maintaining the original order of play.

13. A method of playing a board game of pursuit for at least a first and a second player; and wherein the game board includes a pathway made up from a number of discrete spaces and has a start, a finish, a plurality of hazard spaces disposed at intervals along the pathway, and a plurality of second hazard spaces disposed at intervals along the pathway; and wherein the method of playing the game comprises the steps of the first and second players taking alternating turns to:

a) determine the number of spaces to move along the pathway;

b) decide whether to move their marker in one of a first direction and an opposing second direction along the pathway in order to one of avoid and land upon a space upon which the other of the first and second players has placed their marker c) move their marker in the one of that selected one of the first and second directions;

d) position a marker at the end space so determined; and wherein the method of play further includes:

e) paying a penalty when the marker of the one of the first and second players is positioned on any one of the plurality of hazard spaces and second hazard spaces during play; and wherein the method of play further includes that the hazard spaces apply only to the first player and the second hazard spaces apply only to the second player;

and wherein the game ends immediately when either the second player is able to position their marker on the same space as the first player even if that same space is remote from the finish, or if the first player is able to position their marker on the finish before the second player is able to position their marker on the same space as the first player.

14. The method of playing a board game as defined in claim 13, wherein the step of paying the penalty comprises one of missing one or more turns, moving a predefined number of spaces in one of the first and second directions along the pathway, and having to determine a predefined number of spaces to be moved before play is able to be resumed by the one of the first and second players paying the penalty.

15. The method of playing a board game as defined in claim 14, wherein the pathway on the board further includes a finish and the play of the game ends when the first player is able to position their marker on the finish before the second player is able to position their marker on the same end space as the first player.

16. A method of playing a board game of pursuit for at least a first and a second player; wherein the game board includes a pathway made up from a number of discrete spaces and has a start and a finish; wherein the pathway further includes a plurality of first and second hazard spaces disposed at intervals along the pathway where the first hazard spaces apply only to the first player and the second hazard spaces apply only to the second player; and wherein each player has a marker for positioning on the pathway; and the first player plays first and then the second and first players take alternating turns; and each turn comprises the steps of:

a) determining the number of spaces to be moved along the pathway;

b) counting out the determined number of spaces along the pathway in a first direction to locate a first possible end space;

c) counting out the determined number of spaces along the pathway in an opposing second direction to locate a second possible end space;

d) deciding which one of the first and second possible end spaces upon which to place their marker, wherein said selection is based upon whether the marker of the other of the first and second players is on either of the possible end spaces and whether either of the possible end spaces is one of the plurality of first and second hazard spaces and is applicable to the player taking the turn;

e) positioning their marker onto the selected one of the first and second possible end spaces;

f) paying a penalty if the selected one of the first and second possible end spaces is one of the first and second hazard spaces and is applicable to the one of the first and second players taking the turn;

and wherein the game ends immediately when the second player is able to position their marker on a same end space as the first player, even if that same end space is remote from the finish.

* * * * *